US005410215A

United States Patent [19]

Seo

[11] Patent Number: 5,410,215

[45] Date of Patent: Apr. 25, 1995

[54] DEVICE FOR MOUNTING A SHADOW MASK IN A COLOR TELEVISION TUBE

[75] Inventor: Ho S. Seo, Taegu, Rep. of Korea

[73] Assignee: Goldstar Co., Ltd., Seoul, Rep. of Korea

[21] Appl. No.: 210,632

[22] Filed: Mar. 21, 1994

Related U.S. Application Data

[63] Continuation of Ser. No. 872,854, Apr. 23, 1992, abandoned.

[30] Foreign Application Priority Data

May 3, 1991 [KR] Rep. of Korea ..... 91 6303

[51] Int. Cl.[6] ..... H01J 29/81

[52] U.S. Cl. ..... 313/406; 313/402; 313/404; 313/407

[58] Field of Search ..... 313/402, 404, 406, 407

[56] References Cited

U.S. PATENT DOCUMENTS 3,501,663 3/1970 Burdick ..... 313/406
4,300,071 11/1981 Dougherty et al. ..... 313/406
4,723,088 2/1988 Sone et al. ..... 313/404
5,210,459 5/1993 Lee ..... 313/402

FOREIGN PATENT DOCUMENTS 2442453 3/1976 Germany ..... 313/404
55-109344 8/1980 Japan ..... 313/406

*Primary Examiner*—Sandra L. O'Shea
*Assistant Examiner*—Matthew J. Esserman
*Attorney, Agent, or Firm*—Morgan & Finnegan

[57] ABSTRACT

Disclosed is a device for mounting a shadow mask in a color television tube comprising an engaging hole for receiving a panel pin projected on the skirt of a panel to support the shadow mask, a resilient sloped guide surface for guiding the panel pin, being bent by contacting the panel pin so as to return to the original state with its resilient force thereof when the panel pin is inserted into the engaging hole, a guide groove formed behind the sloped guide surface for smoothly guiding the panel pin toward the engaging hole, and a stopper provided behind the engaging hole for preventing the panel pin from being excessively moved behind the engaging hole so as to properly align it with the engaging hole.

3 Claims, 2 Drawing Sheets

DEVICE FOR MOUNTING A SHADOW MASK IN A COLOR TELEVISION TUBE

This is a continuation of application Ser. No. 07/872,854, filed on Apr. 23, 1992 now abandoned.

FIELD OF THE INVENTION

The present invention concerns a device for mounting a shadow mask in a color television, which obviates possible screen damage during assembly.

TECHNICAL BACKGROUND

Generally, a color television tube comprises a panel 1, funnel 11, electron gun 13 enclosed in the neck portion 12 of the funnel, and shadow mask mounted in the inside of the panel, as shown in FIG. 1.

The shadow mask 3 comprises the effective main portion with a plurality of slits or perforations for passing electron beams, and skirt portion formed almost perpendicularly to the periphery of the effective main portion. The skirt portion has a plurality of frames 4 welded thereto for supporting the shadow mask. Attached to the outside of the frames is a resilient support member 10 with an engaging hole 14 to mount the shadow mask 3 to face the inside of the panel 1. The resilient support member is caught by a panel pin projected on the inside of the panel 1.

When mounting such conventional shadow mask 3 in the inside of the panel 1, the resilient support member 10 attached to the frames 4 is pressed inwardly and moved toward the panel 1, so that the engaging hole 14 is aligned with the panel pin 2. Then, if the resilient support member 10 is released to return to the original position by its resilient force, the panel pin 2 is firmly inserted into the engaging hole 14. However, in this case, if the plural resilient members 10 fixed to the frames 4 of the shadow mask 3 are not moved precisely in parallel with the panel 1, the engaging holes 14 may not only be aligned with the panel pins as shown in FIG. 2, but also the shadow mask 3 may contact the screen of the panel 1 so as to damage the phosphor layers of the screen. Moreover it is very difficult to precisely move the shadow mask toward the panel while pressing the plural resilient support members.

SUMMARY OF THE INVENTION

It is an object of the present invention to provide a device for mounting a shadow mask, whereby simple movement of the shadow mask into the panel without pressing the resilient support members suffices the precise mounting of the shadow mask in the panel.

It is another object of the present invention to provide a device for mounting a shadow mask, whereby the shadow mask may be mounted with a sufficient distance from the screen so as to prevent the damage of the screen.

According to the present invention, a device for mounting a shadow mask in a color television tube comprises an engaging hole for receiving a panel pin projected on the skirt of a panel to support the shadow mask, a resilient sloped guide surface for guiding the panel pin, being bent by contacting the panel pin so as to return to the original state with its resilient force thereof when the panel pin is inserted into the engaging hole, a guide groove formed behind the sloped guide surface for smoothly guiding the panel pin toward the engaging hole, and a stopper provided behind the engaging hole for preventing the panel pin from being excessively moved behind the engaging hole so as to properly align it with the engaging hole.

The present invention will now be described more specifically with reference to the drawings attached only by way of example.

BRIEF DESCRIPTION OF THE ATTACHED DRAWINGS

DETAILED DESCRIPTION OF THE INVENTION

Figure 1:
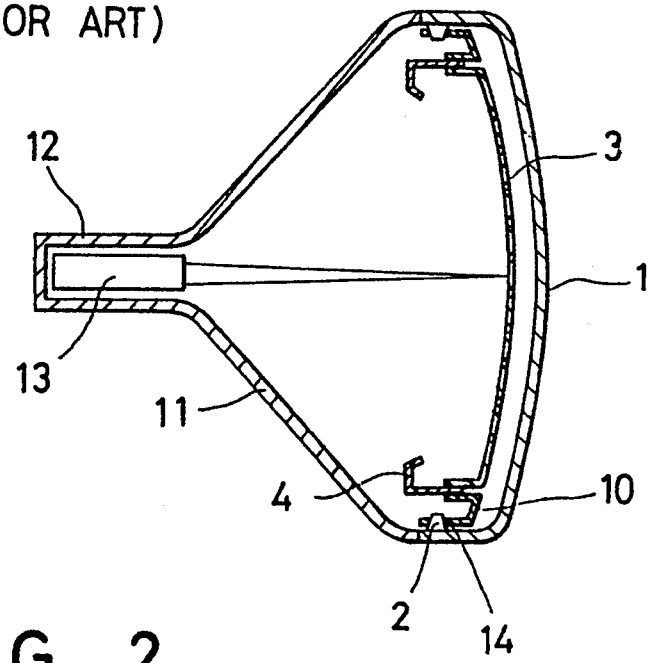
FIG. 1 (PRIOR ART)
FIG. 1 is a cross sectional view of a conventional color television tube.
Figure 2:
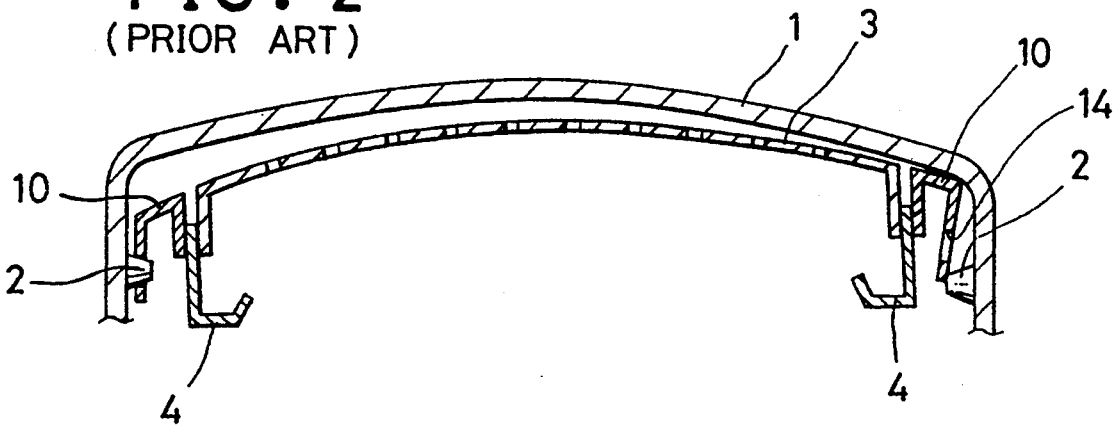
FIG. 2 (PRIOR ART)
FIG. 2 shows a shadow mask misaligned with the panel when using the conventional device for mounting the shadow mask.

Referring to FIGS. 3A, 3B, 4 and 5, a device for mounting a shadow mask in a color television tube comprises a plurality of frames 4 attached to the skirt portion of the shadow mask and a resilient support member 5 with an engaging hole 6 attached to the frame. The engaging hole 6 of the resilient support member 5 receives a panel pin 2 projected on the panel 1.

The resilient support member 5 has a sloped guide surface 7 and guide groove 8. Behind the engaging hole 6 is provided a stopper 9 to prevent the panel pin from being excessively moved behind the engaging hole so as to properly align it with the engaging hole. The guide groove 8 is formed to have an arcuate cross section and the slope smaller than that of the sloped guide surface so as to smoothly guide the panel pin 2 to the engaging hole 6.

Figure 3A:
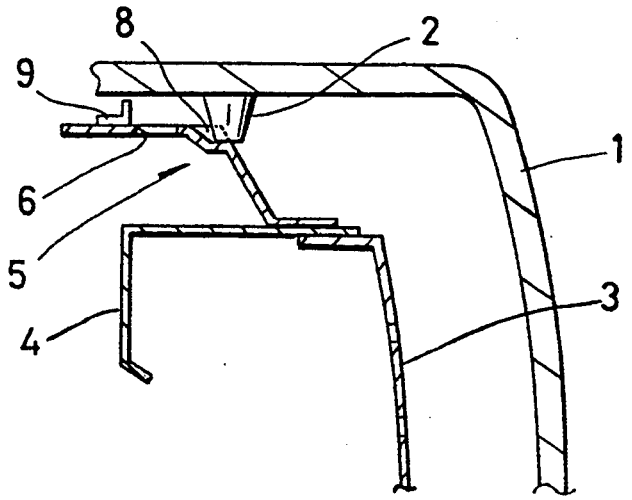
FIG. 3A illustrates the initial step of mounting the shadow mask by using the inventive device.
Figure 3B:
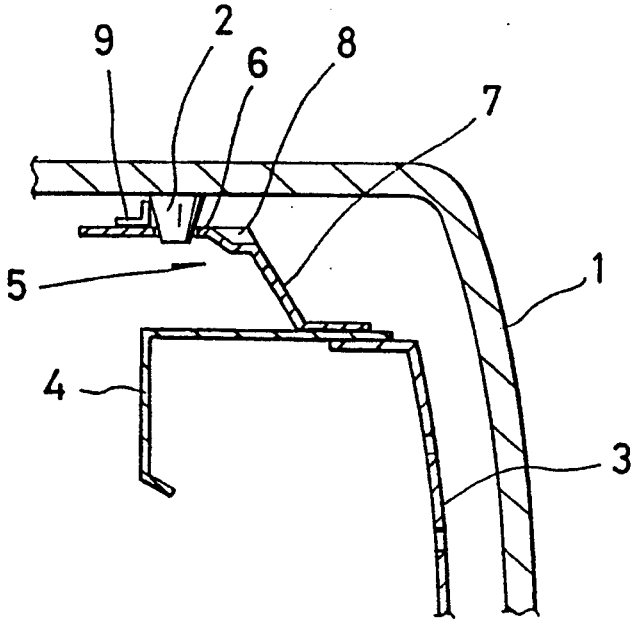
FIG. 3B illustrates the shadow mask completely mounted in the panel by using the inventive device.

In operation, if the shadow mask 3 is moved toward the panel 1, the bottom surface of panel pin 2 formed on the panel 1 presses the sloped guide surface 7 of the resilient support member 5 and is guided by the guide groove 8 to the engaging hole 6, Then, if a further moving of the shadow mask aligns the panel Din 2 with the engaging hole 6, the sloped guide surface 7 which has been pressed by the panel pin resiliently recovers its original position so as to fix the panel pin 2 into the engaging hole 6, Thus, the shadow mask is readily mounted in the panel without manually pressing the resilient support member 5. The stopper 9 is to prevent the panel pin 2 from being excessively moved behind the engaging hole, as shown in FIG. 3B.

Figure 4:
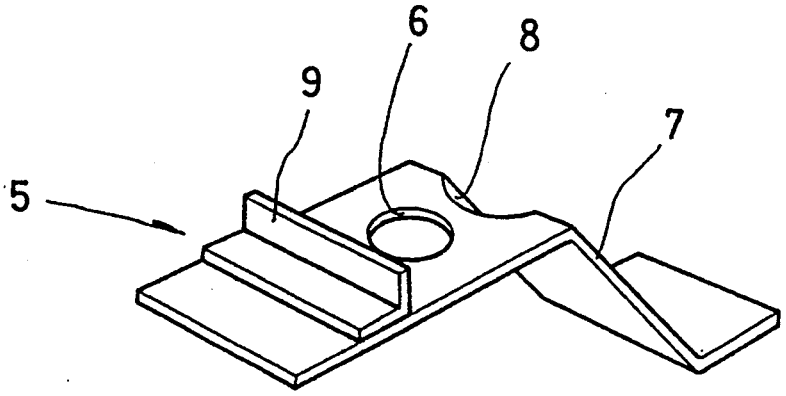
FIG. 4 is a perspective view for illustrating a resilient support member according to an embodiment of the present invention.
Figure 5:
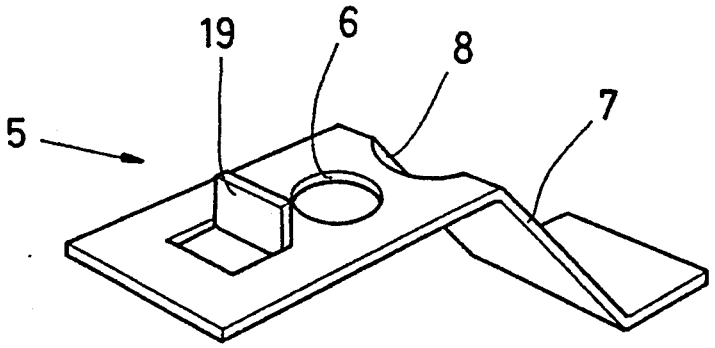
FIG. 5 is a view similar to FIG. 4 for illustrating a resilient support member according to another embodiment of the present invention.

The stopper 9 may be separately prepared and welded to the surface of the resilient support member 5 behind the engaging hole 6 as shown in FIG. 4, or otherwise integrally formed with the resilient support member by bending a portion of the free end thereof as shown in FIG. 5.

As stated above, the inventive device does not need the manually pressing of the resilient support member and prevents the shadow mask from being excessively moved toward the panel screen, thus facilitating the assembly of the shadow mask as well as preventing any possible screen damage and misalignment of the shadow mask.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A device for mounting a shadow mask having a skirt portion in a color television tube, comprising:

a frame connected to the skirt portion of the shadow mask; and a resilient support member connected to said frame and including a) an engaging hole for receiving a panel pin projected on a skirt of a panel to support said shadow mask; said panel pin having a bottom surface for passing through said engaging hole, and an outwardly flared side engaging surface for seating in said engaging hole;

b) a resilient sloped guide surface for guiding said panel pin, and being bent by contacting said bottom surface of said panel pin so as to return to an original state with a resilient force applied to said resilient sloped guide surface when said panel pin is inserted into said engaging hole to seat said side engaging surface therein;

c) a guide groove formed in an upper portion of said resilient sloped guide surface near said engaging hole for smoothly guiding said panel pin toward said engaging hole; and d) a stopper provided behind said engaging hole for preventing said panel pin from being excessively moved behind said engaging hole to properly align said panel pin with said engaging hole; wherein said guide groove has an arcuate cross section and a first slope smaller than a second slope of the lower portion of said resilient sloped guide surface which initially engages said bottom surface of said panel pin to facilitate a smooth transitional guidance of said panel pin into said engaging hole.

2. A device for mounting a shadow mask in a color television as claimed in claim 1, wherein said stopper is formed integrally with said resilient support member.

3. A device for mounting a shadow mask in a color television as claimed in claim 1, wherein said engaging hole is disposed on a surface of said resilient support member, and wherein said surface lies on a different, intersecting plane than said resilient sloped guide surface.

* * * * *